US005318297A

United States Patent [19]

Davis et al.

[11] Patent Number: 5,318,297

[45] Date of Patent: Jun. 7, 1994

[54] GOLF CLUB

[75] Inventors: Stephen Davis, Yardley; Ken Stevens, Lansdale, both of Pa.

[73] Assignee: Prince Manufacturing, Inc., Princeton, N.J.

[21] Appl. No.: 995,953

[22] Filed: Dec. 23, 1992

Related U.S. Application Data

[63] Continuation of Ser. No. 548,091, Jul. 5, 1990, abandoned.

[51] Int. Cl.[5] ..... A63B 53/02; A63B 53/04

[52] U.S. Cl. ..... 273/80.2; 273/167 A; 273/167 E

[58] Field of Search ..... 273/164.1, 167–77 A, 273/193 R, 194 R, 80.2, 80 C, 187.4, 187.6, 186.1, 186.2, 194 R, 77 R; D21/214–220

[56] References Cited

U.S. PATENT DOCUMENTS

| | | | |
|---|---|---|---|
| D. 192,515 | 4/1962 | Henrich | 273/167 E |
| 687,540 | 11/1901 | Palmer | 273/80 C |
| 1,541,126 | 6/1925 | Dunn | 273/167 F X |
| 1,671,956 | 5/1928 | Sime | 273/167 F X |
| 2,708,579 | 5/1955 | Hugman | 273/79 |
| 3,305,235 | 2/1967 | Williams | 273/169 X |
| 3,468,544 | 9/1969 | Antonious | 273/173 |
| 3,698,093 | 10/1972 | Marshall | 273/187.4 |
| 3,829,102 | 8/1974 | Harrison | 273/186 A |
| 3,880,430 | 4/1975 | McCabe | 273/169 X |
| 3,976,299 | 8/1976 | Lawrence et al. | 273/171 |
| 3,979,124 | 9/1976 | Uraneck | 273/186.2 |
| 3,992,015 | 11/1976 | Benson | 273/80.2 |
| 3,997,170 | 12/1976 | Goldberg | 273/164 |
| 4,147,357 | 4/1979 | Strop | 273/164 |
| 4,431,192 | 2/1984 | Stuff, Jr. | 273/167 E |
| 4,653,756 | 3/1987 | Sato . | |
| 4,741,535 | 5/1988 | Leonhardt | 273/164 |
| 4,809,983 | 3/1989 | Langert | 273/167 E |
| 4,828,265 | 5/1989 | Antonious | 273/167 E |
| 4,900,029 | 2/1990 | Sinclair | 273/167 E |
| 4,930,783 | 6/1990 | Antonious . | |

FOREIGN PATENT DOCUMENTS

| | | | |
|---|---|---|---|
| 6236 | 1/1977 | Japan | 273/164 |
| 3118 | 3/1908 | United Kingdom | 273/80 C |
| 14922 | 1/1912 | United Kingdom | 273/174 |
| 364845 | 1/1932 | United Kingdom | 273/174 |
| 683793 | 6/1950 | United Kingdom . | |

OTHER PUBLICATIONS

"Golf Digest" Magazine, Jun. 1977, p. 118 Ad For 'Rough Rider Clubs'.

*Primary Examiner*—Vincent Millin
*Assistant Examiner*—Sebastiano Passaniti
*Attorney, Agent, or Firm*—Brumbaugh, Graves, Donohue & Raymond

[57] ABSTRACT

The present invention relates to a novel golf club having means to impart lift to the club head in order to counteract the forces which are exerted upon the head of the club during the swing that produce a dipping effect.

10 Claims, 7 Drawing Sheets

GOLF CLUB

This application is a continuation of application Ser. No. 07/548,091, filed on Jul. 5, 1990, now abandoned.

The present invention relates to a novel golf club head design, specifically for the type of clubs known as "woods", e.g. the driver, brassie, spoon, etc. The term "wood" is used herein to describe all such clubs irrespective of the material from which they are constructed, such as wood, metal, graphite or composite materials. More specifically, the present invention relates to a head design for woods which imparts lift to the club head and thereby counteracts the "dipping" effect which occurs during the down swing.

BACKGROUND OF THE INVENTION

It has been observed through the analysis of stop-action photographs of the golf swing that during the down swing and principally just prior to contact between the club face and ball (hereinafter referred to as the "downswing"), the centrifugal forces that are generated by swinging the club are sufficient to cause the head of the wood to move off-center, relative to the ball, in the direction toward the plane of the shaft. Stated differently, as the club head approaches impact with the ball, its striking face should be generally square to the ball. A phenomenon called "dipping" alters this desired alignment by changing the vertical plane of the head and shaft so that the club head face (striking surface) and ball are not square at impact, the effect of which is to cause or contribute to an errant shot.

Dipping is believed to be the result of the centrifugal force caused by rotating the club head about a center of rotation. To better understand this concept and the effect produced thereby on the golf club during the portion of the swing from the top of the backswing through impact with the ball, consider that the center of gravity of a normal golf club head is off-set from the axis of the shaft and that during the downswing of the club, the center of gravity point of the head is urged to align itself with the axis of the shaft or the plane of the swing which is basically the same. In short, the head dips so that its center of gravity tends to align with the plane of the swing. As a result of these forces, the shaft bends out of its normal plane. FIG. 1 shows the golf club in an unaltered state at address. FIG. 2, shows the altered state achieved approximately at the ball contact point. As is shown in FIG. 2, the shaft is bending so that the center of gravity of the head is aligning with the plane of the swing. As can be seen, the head tilts at a slight angle which can substantially alter the flight of the ball and quality of the golf shot.

That the dipping phenomenon is not just a function of an individual's swing, has been confirmed by using a mechanical swing apparatus, known as the "Iron Byron" which reproducibly standardizes a golf swing and permits precise analysis of the structural effects on the head and shaft resulting from centrifugal forces throughout the swing. Measurements of the extent of the club head movement, measured vertically, and resulting from the centrifugal forces created during the swing have shown a change in the position of the head up to about one inch.

Applicants are not aware of any woods that are designed or include features that counteract the dipping effect. Golfers who are aware of dipping have sought to counteract the effect by positioning the club head above the ball at address, so that on impact with the ball the face of the club and the ball are substantially square. Of course, it requires considerable skill to make this adjustment to compensate for the dipping effect and the reproducibility factor, even for the good golfer, is far from satisfactory.

Applicants' invention contemplates a novel design modification of the head of a wood, which reduces or substantially eliminates the dipping effect by imparting "lift" to the head as it approaches impact with the ball.

While a review of the relevant prior art patents known to applicants reveals golf club head design features which tend to direct the flow of air in order to reduce air drag on the club and thereby to increase club head speed, none recognizes the dipping effect and none discloses or even suggests the objective of imparting "lift" to the club head. For example, U.S. Pat. No. 4,431,192 discloses the use of "vanes" attached to the head for directing the flow of air in a predetermined pattern to solve the problem of drag in a golf club driver. The patent further discloses that the vanes may be attached to the sole of the club and that they produce a "ram air exhaust effect".

SUMMARY OF THE INVENTION

The present invention contemplates a novel head for a wood having means to impart lift to the club head in order to counteract the downward forces which are exerted up the head of the club and produce the dipping effect. Such means generally include, but are not limited to, wing-like designs or air foils as that term is understood in accordance with aerodynamics theory. The lift means integral to the club head may be formed on the top, bottom or side portions of the club head in one-piece construction or separately attached to or formed on any surface of the club head. Also, the club head may be formed with the top surface substantially longer than the bottom surface. This forces the air speed to flow over the top surface of the club head faster than the bottom surface enhancing lift. Moreover, the lift means may be detachably designed so as to give the club maximum versatility.

DETAILED DESCRIPTION OF THE INVENTION

Figure 1:
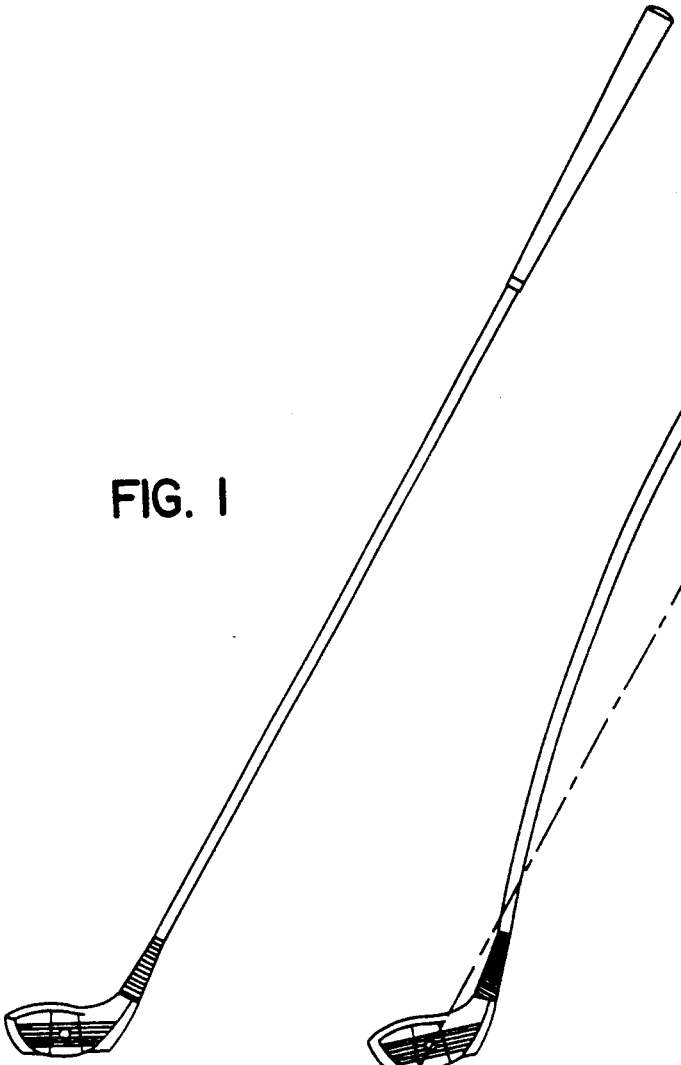
FIGS. 1 and 2 illustrate the "dipping" effect.
Figure 2:
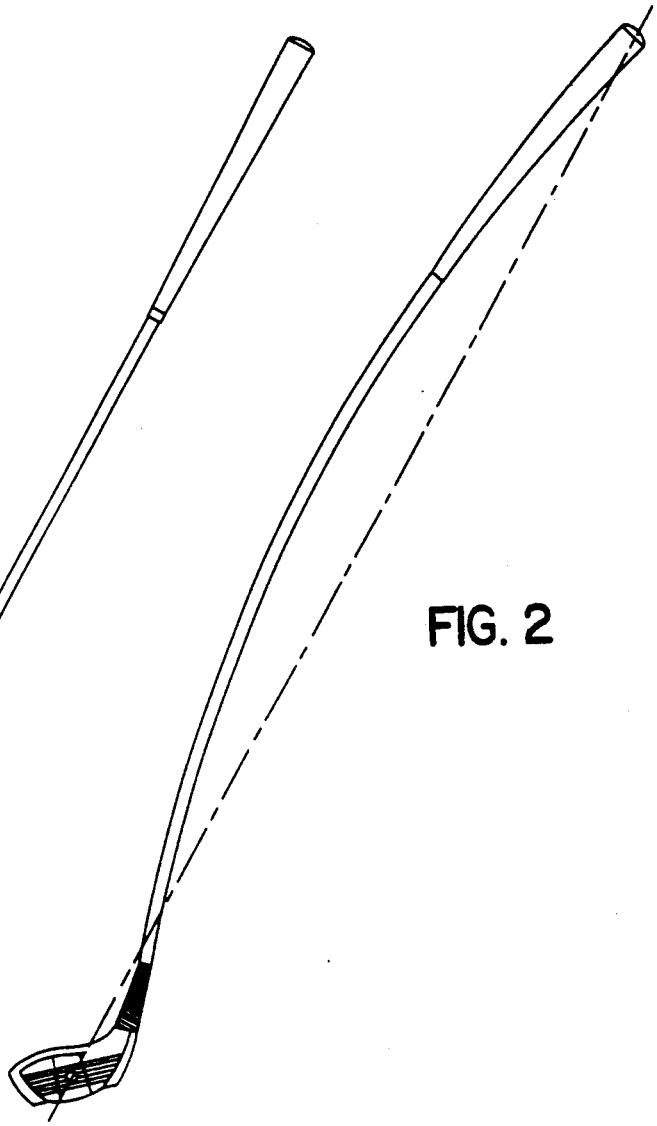
Figure 3:
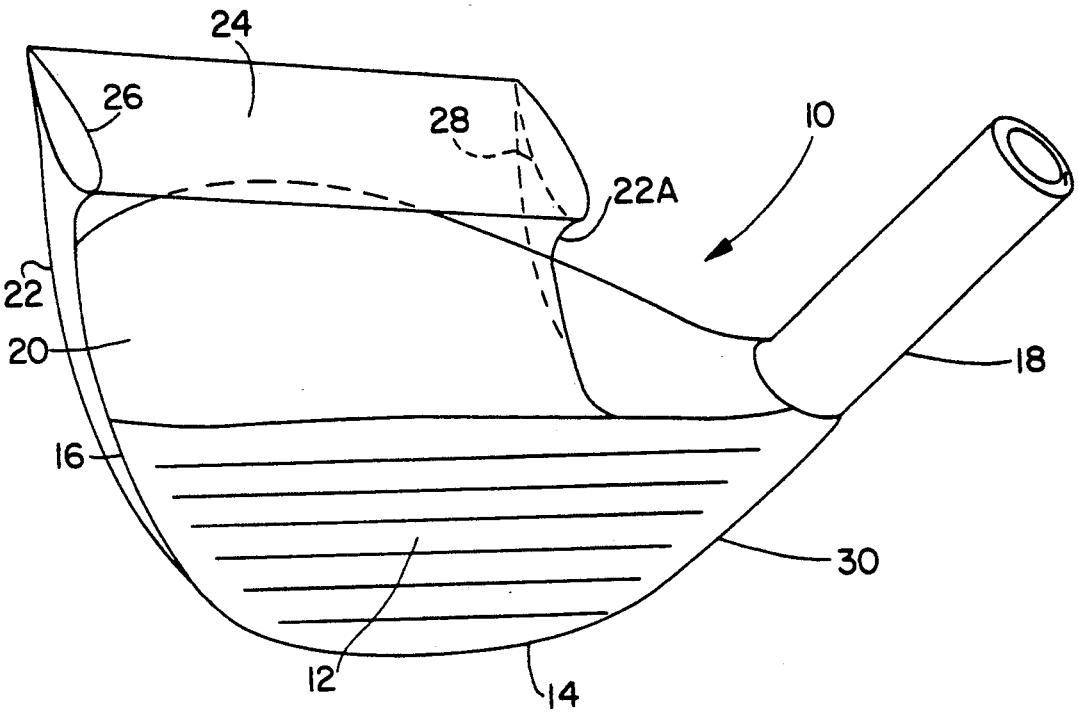
FIG. 3 is a front perspective view of a club head of the present invention illustrating a single wing means mounted on the top surface of the head.

With reference to FIG. 3, golf club head 10 has a ball striking area 12, a bottom surface or sole portion 14, a side toe portion 16, a hosel portion 18, a top surface 20, strut portions 22 and 22A, wing 24 and heel portion 30. Wing 24 is aerodynamically designed with a generally curved top surface 26 and a substantially straight bottom portion 28. Wing 24 is attached to the top surface 20 of the golf club head body 10 by strut means 22 and 22A. For this particular embodiment, strut 22 is formed as a continuation of the toe portion of the club head and as depicted the strut is integrally formed. However any suitable strut design to support wing 24 is contemplated to be within the scope of the invention. Strut 22A is illustrated as projecting vertically forward of the hosel 18; however its precise location would of course depend on the size of wing 24, which as depicted nearly extends the entire length of the head. It should further be understood that wing 24 can be supported by a single strut, thereby creating a "T" shaped strut and wing configuration.

Figure 4:
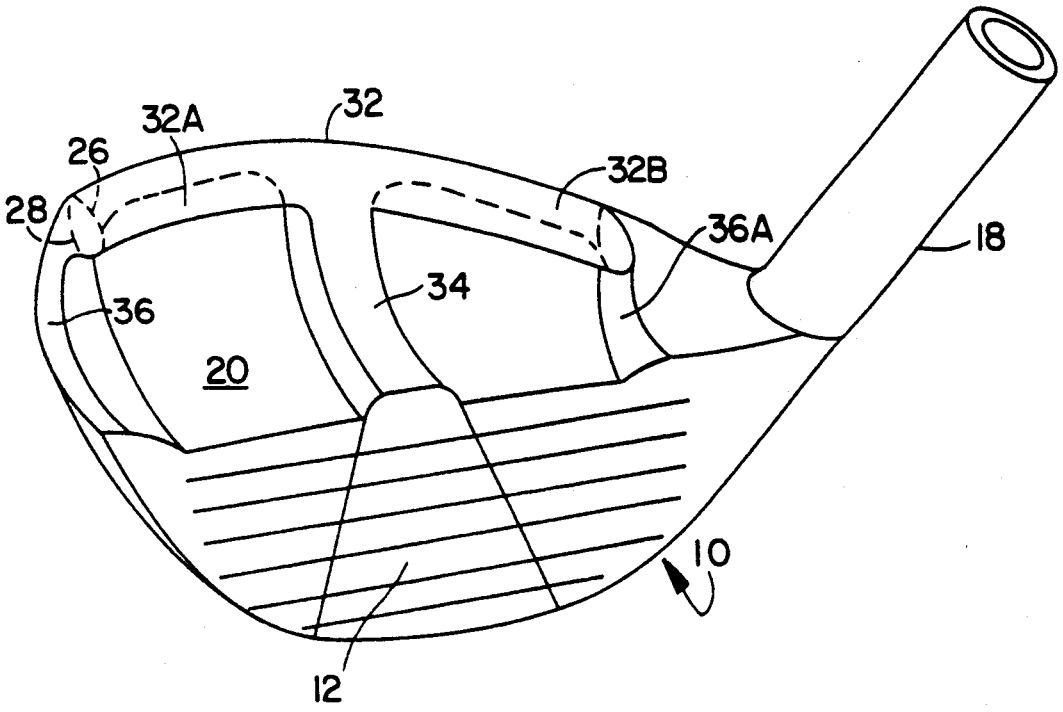
FIG. 4 is a front perspective view of a club head of the present invention illustrating a double wing and cross brace construction.
Figure 5:
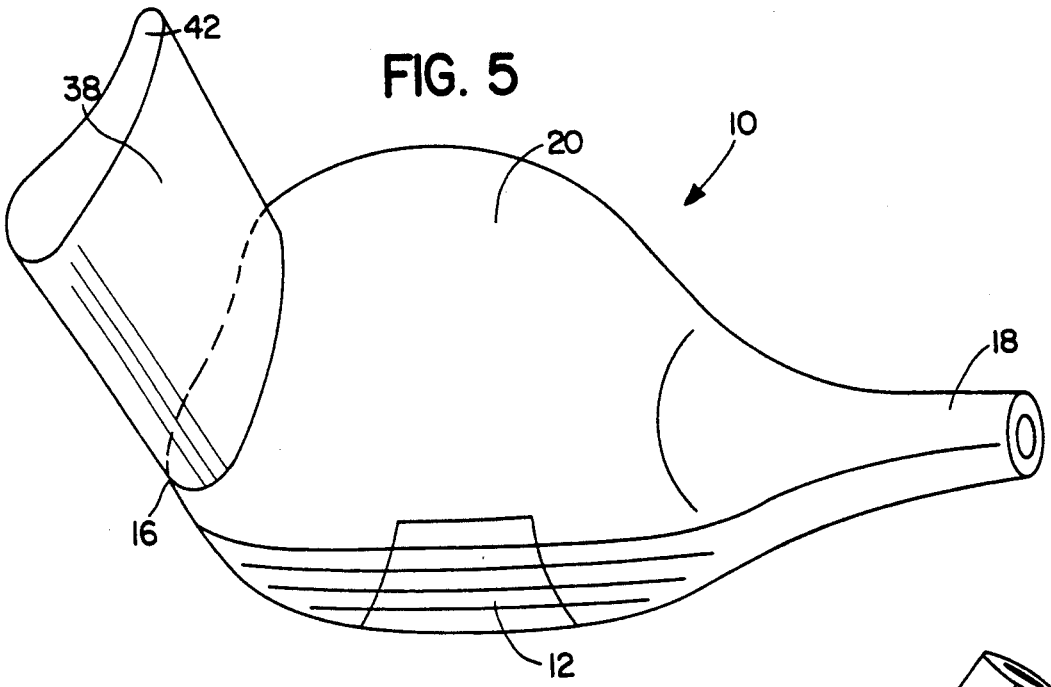
FIG. 5 is a top perspective view of a club head of the present invention illustrating a wing means vertically mounted on the top portion of the head.
Figure 6:
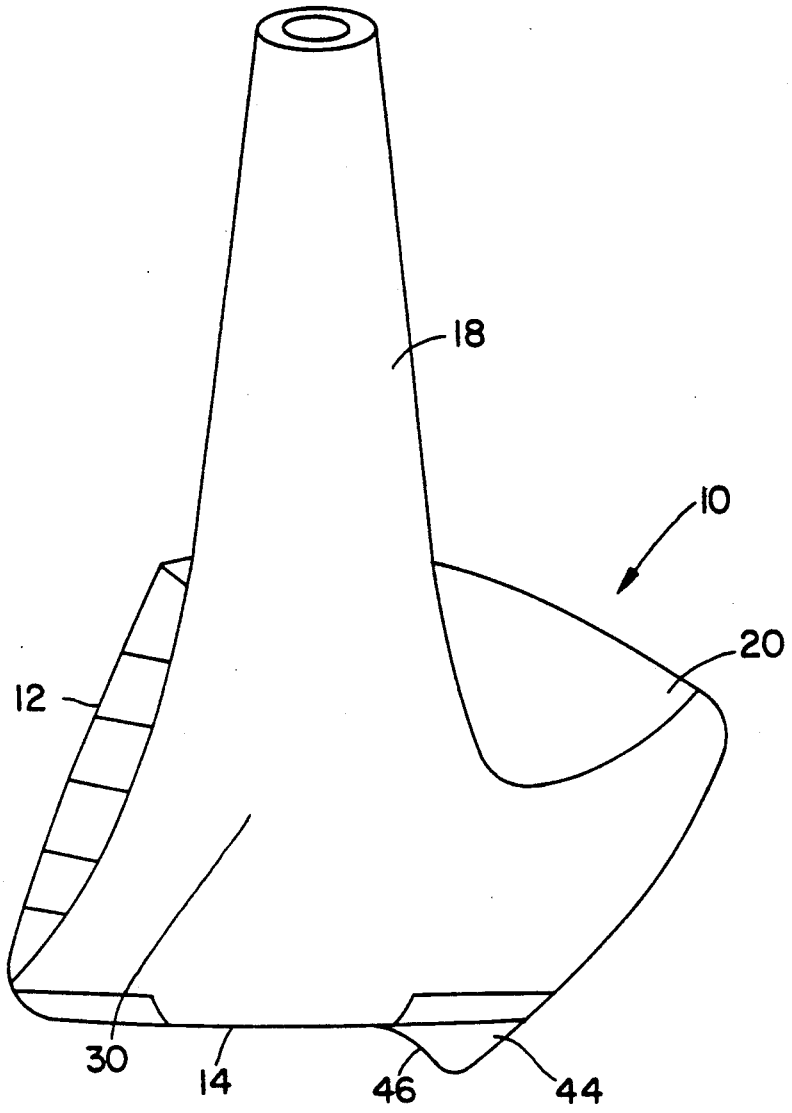
FIG. 6 is a rear perspective view of a club head of the present invention illustrating a lift means formed on the sole portion of the club head.

The present invention is further disclosed in the context of the club head designs illustrated in FIGS. 4–6. Specifically, FIG. 4 illustrates a top surface 20 of club head 10 formed with a dual wing means 32. In this embodiment, the wing sections 32A and 32B are joined by cross bar 34 which acts to support the dual wing structure along with the two side struts 36 and 36A. In this embodiment, the wing portions are aerodynamically designed to have a curved top surface and a generally flat bottom surface and utilizing a one-piece construction technique.

Figure 5A:
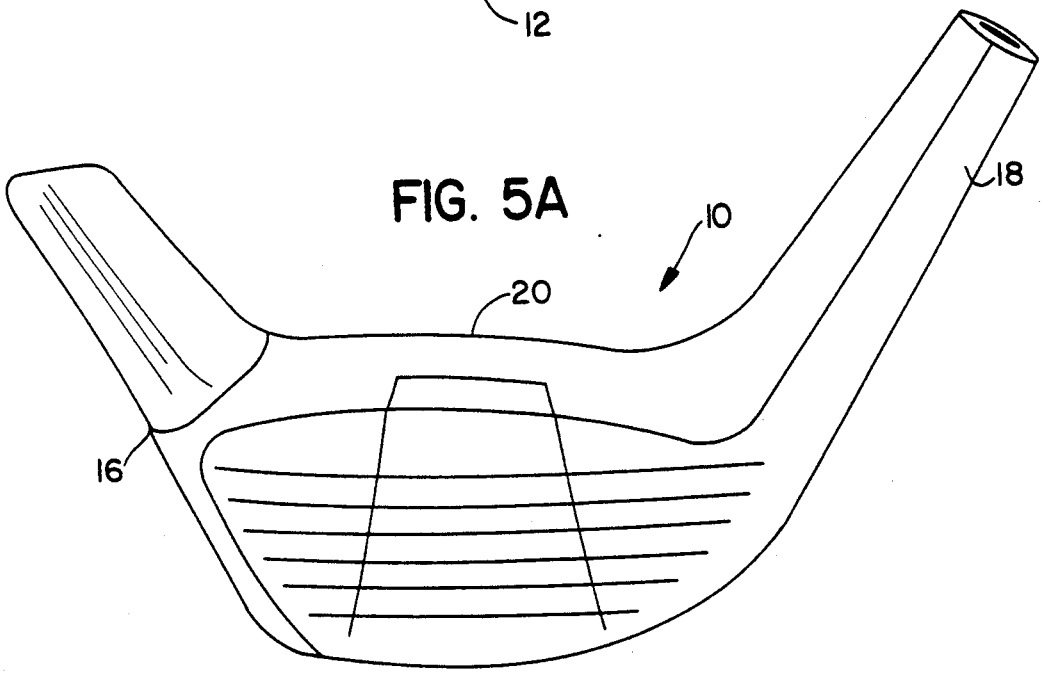
FIG. 5A is a perspective view of the face portion of the head illustrated in FIG. 5.

A particularly preferred embodiment, is illustrated in FIGS. 5 and 5A. In this embodiment of the club head of the present invention, the lift means 38 is a wing structure projecting from the toe portion 16 of the club head 10. Since the wing is aligned in a diagonal plane of the toe portion 16 of the club head, the curved surface 40 of the wing is that facing the hosel 18 and the generally straight portion 42 of the wing 38 is the opposite surface. In this configuration, the wing imparts greater lift due to the change in the "angle of attack", i.e., the angle at which the wing strikes the wing surfaces. The preferred angle of the toe wing is generally perpendicular to the shaft; however, other characteristics of the golf club such as swing weight and shaft stiffness may influence the choice of angle used in positioning the toe wing on the club head.

FIG. 6 illustrates a lift means that is formed on the sole portion 14 of club head 10. Specifically lift means 44 has a substantially concaved front surface 46, which causes the air flow across the surface of sole 14 to be directed downwardly thereby imparting an upward lift to the club head.

Figure 7:
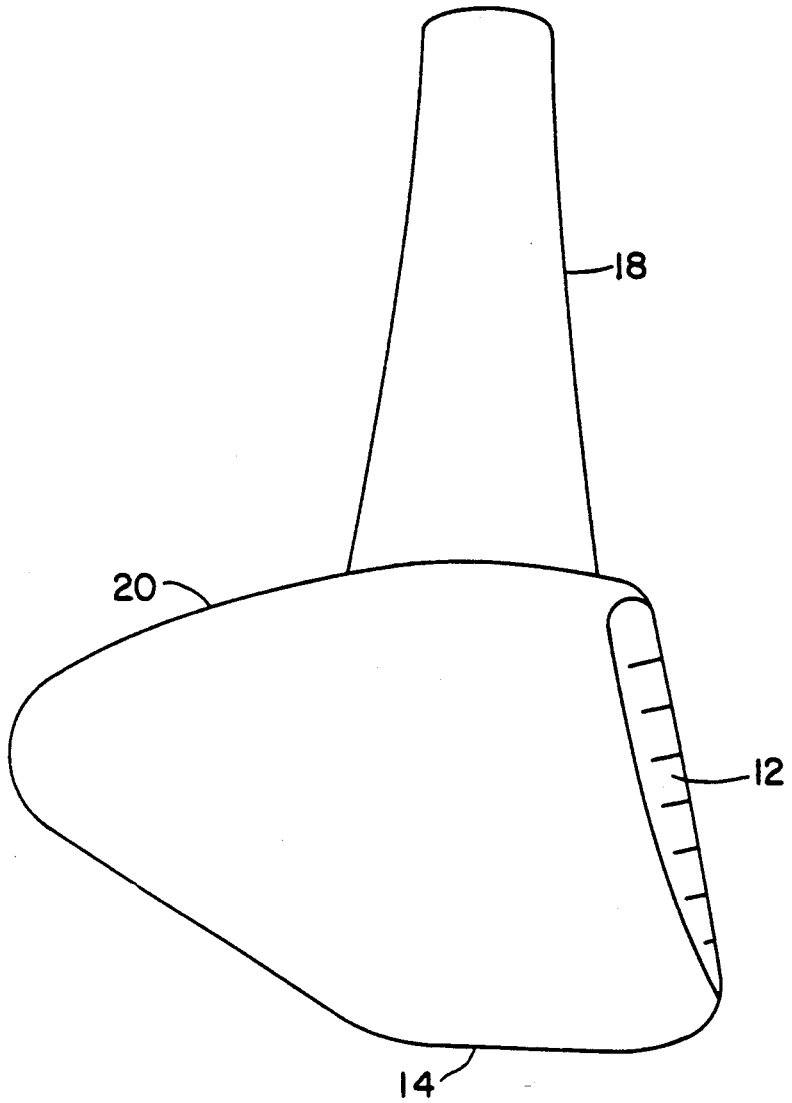
FIG. 7 is a perspective view of a club head of the present invention taken from its toe portion illustrating a top surface substantially longer than the bottom surface.

FIG. 7 illustrates a golf head with the top surface 20 substantially longer than the bottom surface or sole portion 14. This forces the air to flow over the top surface faster than the bottom surface thereby enhancing lift.

Figure 8:
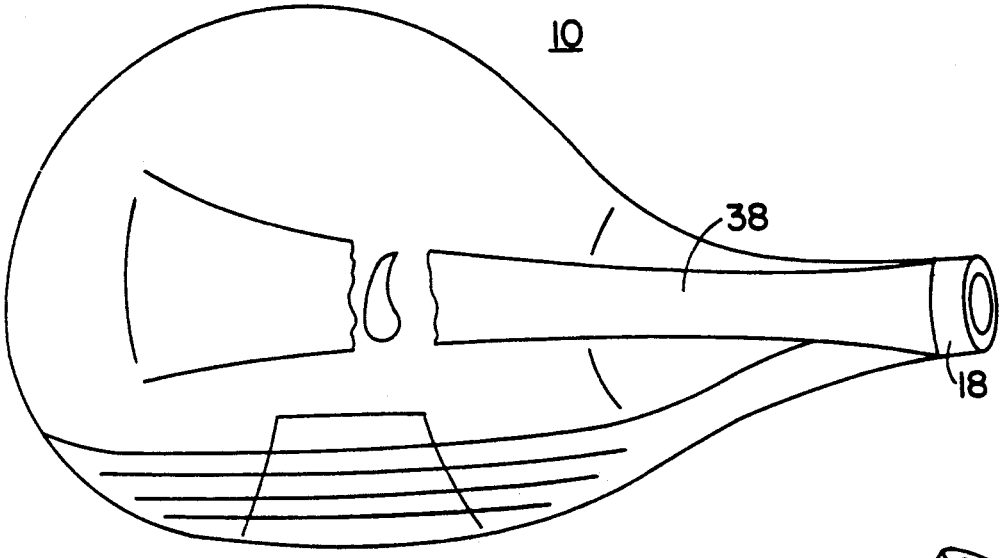
FIG. 8 is a top perspective view of a club head of the present invention illustrating an aerodynamic strut connecting the toe area of the head with the hosel.
Figure 9:
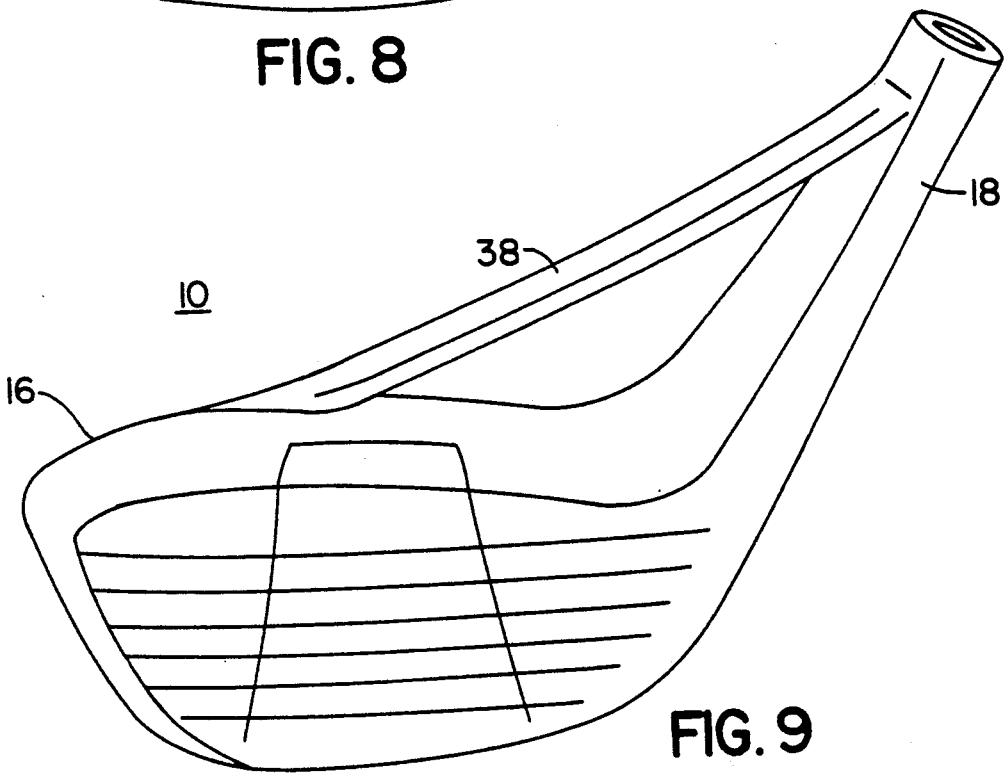
FIG. 9 is a front perspective view of the club head as illustrated in FIG. 8.

FIGS. 8 and 9 illustrate a further embodiment of the club head of the present invention wherein the lift means 38 is an aerodynamic strut connecting the toe portion 16 of the head 10 with the hosel 18. The cross-section of the strut 38 is such that air flow over the strut will create a lifting effect.

Having defined the present invention in detail in terms of the figures disclosed herein, applicants nevertheless do not intend to limit the scope of the invention to these specific embodiments, but rather by this specification seek to encompass any and all structural means formed on or made a part of the golf club head hosel or shaft that imparts lift to the club head as its velocity increases through the down swing and to impact with the ball. For example the lift means may project horizontally from the toe portion 16 and/or the heel portion 30; or the lift means may comprise one or more wing like structures incorporated into an opening, channel or groove formed in the head. The opening, etc. would be covered by a face plate that would permit the passage of air freely but still provide a suitable ball striking surface.

The lift means may be fabricated from the same or different materials used in the construction of the club head. Nevertheless, it is important that the weight is kept to a minimum, but without loss of structurally integrity of the club head and lift means. The overall configuration of the lift structure should be designed to give maximum lift yet be aesthetically pleasing. The span of the wing means used to impart lift may range from about 5 to 50 mm., however this range should not to be construed as critical.

We claim:

1. A golf club comprising a head, shaft and grip, said head having toe, sole, heel and top portions and a hosel formed in the head proximally to said heel portion, said golf club further comprising lift means to impart lift to the head prior to the point of contact between the head and a golf ball, wherein said lift means comprises a wing extending above said top portion, said wing having at least one curved top surface and one relatively straight bottom surface, said top and bottom surfaces extending substantially from said hosel to said toe and said wing being attached to the head.

2. A golf club according to claim 1 wherein the wing is supported by at least one strut.

3. A golf club comprising a head, shaft and grip, said head having a sole portion which is relatively flat, toe, heel and top portions and a hosel formed in the head proximally to said heel portion, said golf club further comprising lift means to impart lift to the head prior to the point of contact between the head and a golf ball, wherein said lift means is formed on the sole portion of the head, said lift means having a substantially concaved front surface which projects below said relatively flat sole portion, said concaved front surface facing downward, whereby air flow across said sole portion is directed downwardly and an upward lift is imparted to said head.

4. A golf club according to claim 1 or claim 3 wherein the lift means is integrally formed in one piece construction.

5. A golf club according to claim 1 or claim 3 wherein the lift means is detachable from the head.

6. A golf club comprising a head, shaft and grip, said head having toe, sole, heel and top portions and a hosel formed in the head proximally to said heel portion, said golf club further comprising lift means to impart lift to the head prior to the point of contact between the head and a golf ball, wherein said lift means comprises an aerodynamic strut located between the toe and hosel portions of the head said strut having at least one curved top surface and one relatively straight bottom surface.

7. A golf club according to claim 6 wherein the strut has a cross-sectional airfoil shape having an outer surface which causes air flowing over the strut to impart an upward lift to the club head as the club head moves toward the contact point between the head and golf ball.

8. A golf club comprising a head, shaft and grip, said head having a toe, sole, heel and top portions and a hosel formed in the head proximally to said heel portion, said golf club further comprising lift means for imparting lift to the head prior to the point of contact between the head and a golf ball, wherein said lift means comprises a wing having a span, said wing projecting from the head, said wing having at least one curved top surface and one relatively straight bottom surface, the maximum thickness between said top and bottom surfaces being less than said span, and said wing being attached to the head to impart lift to the head.

9. A golf club according to claim 1 or 8 wherein the wing is an aerodynamic strut connecting the toe portion of the head with the hosel.

10. A golf club according to claim 9 wherein the strut has a cross-sectional airfoil shape having an outer surface which causes air flowing over the strut to impart an upward lift to the club head as the club head moves toward the contact point between the head and golf ball.

* * * * *

UNITED STATES PATENT AND TRADEMARK OFFICE

CERTIFICATE OF CORRECTION

PATENT NO. : 5,318,297

DATED : June 7, 1994

INVENTOR(S) :

Davis et al.

It is certified that error appears in the above-indentified patent and that said Letters Patent is hereby corrected as shown below:

On the title page, item [56]: between 2nd and 3rd lines, insert --4,065,133 12/1977 Gordos--

Signed and Sealed this

First Day of November, 1994

*Attest:*

*Attesting Officer*

BRUCE LEHMAN

*Commissioner of Patents and Trademarks*